United States Patent [19]

Hormann

[11] 4,120,072

[45] Oct. 17, 1978

[54] COMBINED SUPPORTING ROLLER-FRICTION DRIVE ARRANGEMENT FOR OVERHEAD SINGLE-PANEL DOORS

[75] Inventor: Michael Hörmann, Steinhagen, Germany

[73] Assignee: Hormann KG Amshausen, Germany

[21] Appl. No.: 827,092

[22] Filed: Aug. 23, 1977

[30] Foreign Application Priority Data

Aug. 26, 1976 [DE] Fed. Rep. of Germany ..... 7626729

[51] Int. Cl.[2] ..... E05D 13/02

[52] U.S. Cl. ..... 16/87 R; 160/201

[58] Field of Search ..... 16/87 R, 87 B, 87.4 W, 16/87.6 R, 87.8, 94 D, 97, 98, 102, 107; 49/197, 199, 200; 160/201, 202, 209

[56] References Cited

U.S. PATENT DOCUMENTS

| | | | |
|---|---|---|---|
| 1,985,976 | 1/1935 | Clark | 160/209 |
| 3,169,574 | 2/1965 | Behlen | 160/201 |
| 3,202,415 | 8/1965 | Lodge | 49/28 |
| 3,412,280 | 11/1968 | Moler | 160/201 |
| 3,484,812 | 12/1969 | Holland | 160/201 |
| 3,552,474 | 1/1971 | Finnegan | 160/201 |

*Primary Examiner*—Ronald Feldbaum
*Attorney, Agent, or Firm*—Craig & Antonelli

[57] ABSTRACT

Apparatus is provided for supporting and drivingly opening and closing an overhead single-panel door such as a garage door. The apparatus includes drive rollers protruding from the plane of the door at respective opposite upper corners thereof, which drive rollers are bearingly supported by a plate member attached to the door. These drive rollers are supported from underneath and in driving contact with fixed guide tracks arranged at the building accommodating the door. In order to insure continuous firm driving engagement of the drive rollers with the topside of the guide track, a bearing bracket is rotatably supported at the drive roller axles, which bearing bracket in turn supports a pair of counterpressure rollers engageable directly at the underside of the guide track. The counterpressure rollers are spaced from one another in the direction of travel of the guide roller at respective opposite sides of a line through the axle with the drive roller and extending downwardly, such that at least one of these counterpressure rollers is continuously in supporting backing engagement with the guide track so as to assist in assuring a firm driving contact between the guide rollers and the guide track. In preferred embodiments, an additional spring support system is provided between the drive roller and the bracket supporting the drive roller axle and the door, so as to provide an additional biasing force in the downward direction on the drive roller. In preferred embodiments, the guide track is constructed as a C-shaped cross-sectional member, and the bearing bracket includes an extension which protrudes over the top of the guide track as a safety measure to support the door in the event of an axle breakage or the like.

10 Claims, 2 Drawing Figures

COMBINED SUPPORTING ROLLER-FRICTION DRIVE ARRANGEMENT FOR OVERHEAD SINGLE-PANEL DOORS

BACKGROUND AND SUMMARY OF THE INVENTION

The invention relates to a combined supporting roller-friction drive arrangement for overhead single-panel doors, particularly for garages or the like. Such arrangements comprise in the upper edge zone of the door panel on both sides respectively one projecting drive roller coupled to a drive mechanism—especially of the electric motor type—for rotation therewith. These projecting drive rollers engage fixed guide tracks extending approximately horizontally with the drive rollers being held, with respect to their mounting at the door panel to be adjustable in such a way that, in the closed position of the door panel, the respective drive roller is under pressure by a spring load approximately vertically toward the bottom of the guide track, to ensure a friction engagement between the drive roller and the bottom of the track.

Single-panel doors are fastened by means of an articulated linkage. Consequently, the guide rollers laterally projecting in the upper edge zone of the door panel do not execute a linear motion in the tracks, which tracks extend approximately horizontally. Particularly in the initial phase of the movement from the closed position into the opened position, the supporting drive rollers describe an upwardly curved path, and on account of this fact the drive rollers, in case of linear guide tracks, are not constantly in engagement with the bottom of the guide tracks. Attempts have been made to take these motion processes into consideration by arranging the running tracks at the ends on the frame side to be displaceable under spring force so that the guide tracks follow the drive rollers, to achieve the result that the drive rollers remain in contact with the bottom of the guide track in any phase of motion. Such a construction is relatively expensive and relatively cumbersome especially in view of the mass of the guide tracks controlled by spring force.

It has also been contemplated to construct the mounting of the supporting and friction drive rollers so that they can be exposed to a spring load in the direction toward the bottom of the guide track. Although this system affords advantages with regard to the masses to be moved under spring force, the spring load is dependent on the angle with respect to the bottom portion of the guide tracks during the course of the movement, i.e. in the closed position the springs urge the drive rollers approximately vertically onto the guide bottom, whereas in the opened position of the door the pressure component extends practically in the direction of the guide tracks so that there is hardly any pressure component exerted on the drive rollers which is directed toward the bottom of the guide. Considering the drive relationships dynamically, a satisfactory result can be obtained in such a spring-loaded pressure roller system if the door is moved without interruptions from the closed position into the opened position and vice versa, but if there are obstacles of any kind, for example by an intermittent wind pressure or the like, it can happen that the drive rollers no longer find sufficient frictional hold on the bottom of the guide tracks to continue the movement of the door in the intended direction. Thus, the door is arrested in a certain intermediate position and/or undesirably the smooth motion process is interrupted.

The invention contemplates an arrangement which ensures that a door of the type under consideration herein, with the arrangement described in the foregoing, can be moved under any circumstances smoothly and without disturbances from the closed position into the opened position and vice versa.

This object is attained in accordance with the invention by providing that a bearing bracket is rotatably mounted to the drive roller axle, with two counterpressure rollers arranged to be displaced in the direction of movement of the drive rollers and engaging underneath the running track being supported at this bearing bracket.

It is basically conventional to ensure the frictional drive of motor-driven rollers on guide tracks by the provision of a counterpressure roller (for example U.S. Pat. No. 3,202,415). However, these prior disclosures are limited to the feature of providing, in principle, a sufficient contact pressure, independently of the weight of the door to be moved. So-called sectional doors are involved which have a drive element mounted in front thereof which insofar operates independently of the weight of the door and is not concerned with the aforedescribed problems encountered in connection with an arcuate movement of the rollers of a single-panel door.

In accordance with the invention, the drive rollers driven by the drive mechanism and mounted adjustably under spring load at the door panel are held in any imaginable motion situation in secure frictional contact with the bottoms of the guide tracks. In this connection, it is to be kept in mind that, due to the motion, a pivoting of the bearing bracket takes place which ensures that, in dependence on the closing or opening motion, respectively one of the counterpressure rollers contacts the bottom of the running track.

In a preferred embodiment, the axles of the counterpressure rollers are held at the bearing bracket in the direction toward contacting the lower outside of the running track under spring load. This feature supports the intended pressure contact of the roller against the bottom of the running track.

In another preferred embodiment, the axles of the counterpressure rollers are vertically adjustable in the direction toward the axle of the friction roller.

Finally, in a further preferred embodiment of the invention, the bearing bracket is fashioned in its upper zone so that it extends over the running track; consequently, the door is secured from falling off in case the rollers can no longer execute their supporting function. Such a safety feature is known per se in isolation, but not in the novel combination of the present invention.

These and other objects, features and advantages of the present invention will become more apparent from the following description when taken in connection with the accompanying drawings, which show, for purposes of illustration only, a single embodiment in accordance with the present invention.

DETAILED DESCRIPTION OF THE DRAWINGS

Figure 1:
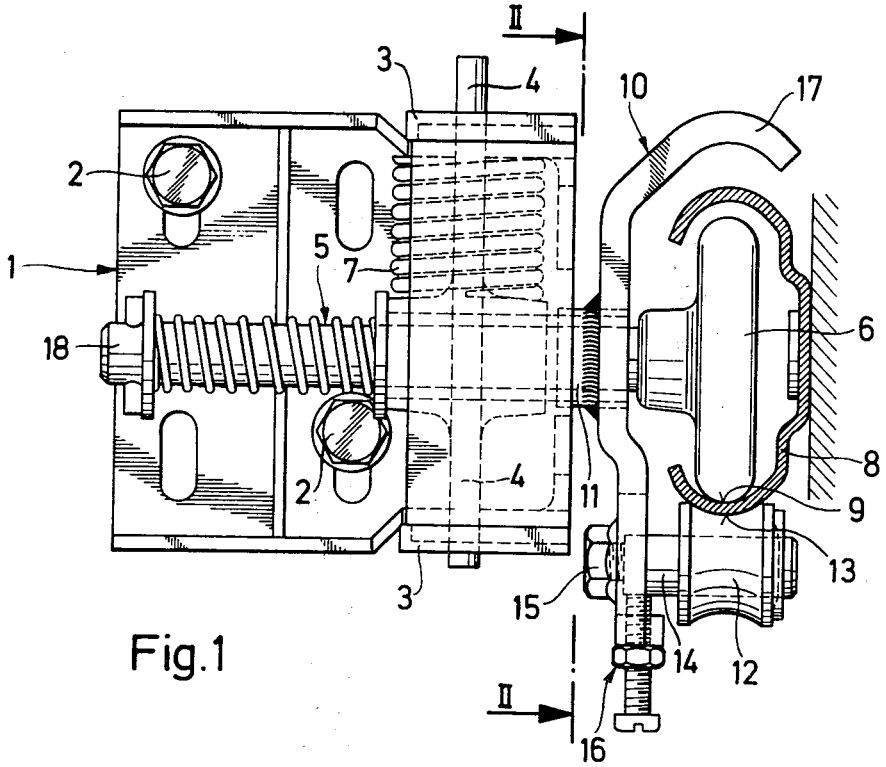
FIG. 1 is a schematic view which shows a lateral view of the arrangement of the present invention in the direction of the running track.
Figure 2:
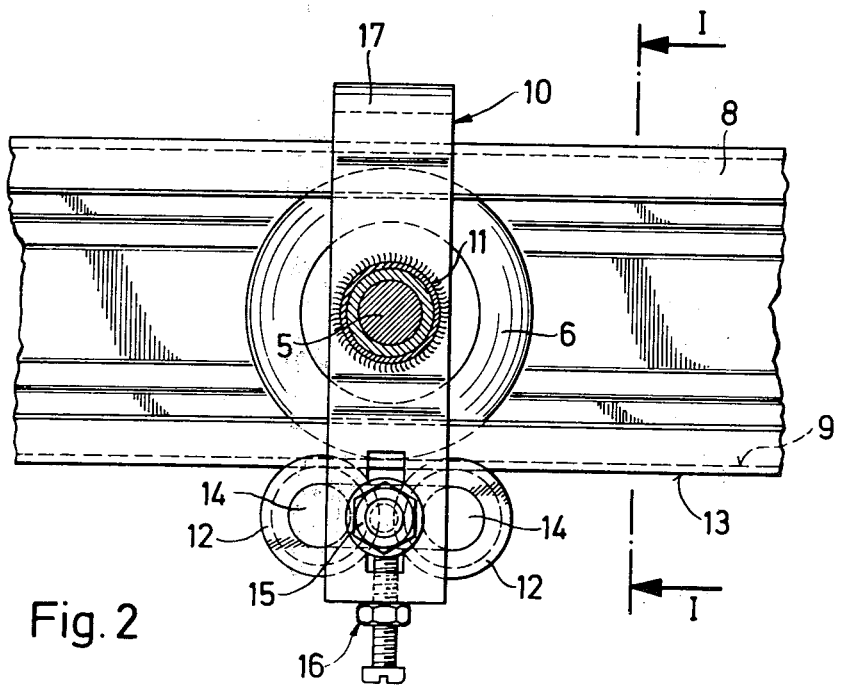
FIG. 2 is a view along section line II—II in FIG. 1.

The illustrated embodiment comprises a mounting plate 1 attached to the door panel to be moved with the aid of screws 2 inserted in slotted-hole recesses. A bearing mechanism 4 for the axle 5 of a drive roller 6 is supported in fishplates 3, bent at a right angle and pertaining to the mounting plate 1, so that the axle is guided to be displaceable in parallel to the plane of the door panel and in the direction of movement of the latter. The bearing mechanism 4 housing the axle 5 is under the effect of a coil spring 7 which presses the axle 5 of the roller 6 downwardly, as seen in the closed position of the door. The roller is inserted in a C-shaped guide track 8 and is pressed, with the aid of the spring 7, against the bottom 9 of this running track 8. Such a device is known per se.

To prevent the roller 6 from coming out of engagement with the bottom 9 of the running track 8, no matter what operating conditions prevail, a bearing bracket 10 is provided which is rotatably supported with the aid of a hub-shaped protuberance 11 on the axle 5 of the roller 6. At the lower end of the bearing bracket 10, two counterpressure rollers 12 are arranged in the direction of the running track at mutual spacings so that their peripheral track contacts the underside 13 of the running track 8. The axles 14 of the counterpressure rollers 12 are preferably threadedly mounted, for example, at 15 to the bearing bracket 10 so that the counterpressure rollers 12 are biased (pretensioned) in the direction toward the underside 13 of the running track 8. In other non-illustrated preferred embodiments with such a biasing feature (leaf spring element support of axles 14 of counterpressure rollers 12), a spring-loaded support of the drive roller at the door panel may be omitted. Since the drive forces are greatest in the initial phase of the door motion from the closed position, however, the supporting spring 7 for the roller displaceably mounted to the door panel has a particularly favorable effect along the lines of exerting an additional contact pressure.

In the illustrated preferred embodiment, in adaptation to constructional conditions, an adjusting means 16 is provided making it possible to fashion the axles 14 of the counterpressure rollers 12 at the bearing bracket 10 to be adjustable in the direction toward the running track and/or the axle 5 of the drive roller 6.

However, other preferred embodiments are contemplated which exclude the adjusting means 10 since the same is not absolutely necessary because the bearing bracket, when the drive roller 6 is driven, assumes an oblique position as a reaction to the drive motion so that always one of the two rollers is perforce in contact with the bottom side 13 of the running track 8.

The bearing bracket 10 is provided in its upper zone with an arcuate extension 17 extending over the upper termination of the running track 8. If the running roller 6 and/or its axle 5 fail due to breakage, then the door is held securely against falling down by the feature that the extension 17 of the bearing bracket 10 contacts the topside of the running rail 8.

It is furthermore noted that the axle 5, connected with the drive roller 6 for rotation therewith, can be connected via a coupling element 18 to the drive shaft of a drive mechanism of the electric motor type.

By means of the arrangement of this invention, a friction-wheel drive via the supporting drive rollers of a single-panel door can be ensured in any operating position, especially also if the motion process is impeded or interrupted by the action of wind or the like. The lifting off of the drive roller from the bottom of the running track, occurring during the course of the dynamic motion of the door, is safely prevented. Consequently, a door drive arrangement is made available which can be fully utilized up to the limits of the friction force and/or the drive power of the drive mechanism. Only such a drive system offers the security which otherwise can only be provided by more expensive drive systems operating with a form-fitting (positively joined) characteristic.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

I claim:

1. Apparatus for supporting and frictionally drivingly opening and closing an overhead single-panel door such as a garage door or the like; said apparatus comprising:

a drive roller having a drive roller axle;

drive roller support means for rotatably supporting said drive roller at a door with said drive roller axle disposed to be rotatably driven by driving means;

a relatively fixed guide track frictionally drivingly engageable with said drive roller along one side thereof;

a bearing bracket rotatably supported at said drive roller axle, and a pair of counterpressure rollers rotatably supported at said bearing bracket and being engageable with a side of said guide track opposite said one side at respective positions of the guide track spaced from one another in the direction of travel of the drive roller, whereby said counterpressure rollers assist in assuring continuous frictional driving contact of said drive roller and said guide track.

2. Apparatus according to claim 1, wherein said drive roller support means includes drive roller support spring means for applying a spring load against said drive roller tending to force the drive roller into driving engagement with the guide track at least when said door is in a closed position.

3. Apparatus according to claim 2, wherein said one side of said guide track faces upwardly to support said drive roller thereon.

4. Apparatus according to claim 3, wherein a support spring system is provided for resiliently forcing the counterpressure rollers into contact with said guide track.

5. Apparatus according to claim 1, wherein a support spring system is provided for resiliently forcing the counterpressure rollers into contact with said guide track.

6. Apparatus according to claim 4, wherein said support spring system includes leaf spring means at the bearing bracket.

7. Apparatus according to claim 3, further comprising counterpressure roller adjusting means for adjusting the position and therewith the pressure of said counterpressure rollers against said guide track.

8. Apparatus according to claim 3, wherein said bearing bracket includes an extension extending over the topside of the guide track.

9. Apparatus according to claim 3, wherein said drive roller assumes, under the effect of pressure, from a spring of said spring means, a displaced position relative to the door which is lower when said door is closed than with an open door, said spring means being supported at a bearing for said drive roller as well as at one of said door and a mounting plate of said drive roller support means.

10. Apparatus according to claim 3, wherein two of said drive rollers are provided, one each at opposite lateral sides of an upper edge portion of said door.

* * * * *